US010174393B2

(12) United States Patent
Suto et al.

(10) Patent No.: US 10,174,393 B2
(45) Date of Patent: Jan. 8, 2019

(54) STEEL SHEET FOR CAN WITH HIGH BARREL-PART BUCKLING STRENGTH UNDER EXTERNAL PRESSURE AND WITH EXCELLENT FORMABILITY AND EXCELLENT SURFACE PROPERTIES AFTER FORMING, AND PROCESS FOR PRODUCING SAME

(75) Inventors: Mikito Suto, Chiba (JP); Katsumi Kojima, Fukuyama (JP); Masaki Tada, Fukuyama (JP); Takumi Tanaka, Fukuyama (JP); Yoichi Tobiyama, Chiba (JP)

(73) Assignee: JFE Steel Corporation, Tokyo (JP)

( * ) Notice: Subject to any disclaimer, the term of this patent is extended or adjusted under 35 U.S.C. 154(b) by 595 days.

(21) Appl. No.: 14/112,717

(22) PCT Filed: Apr. 19, 2012

(86) PCT No.: PCT/JP2012/002709
§ 371 (c)(1),
(2), (4) Date: Oct. 18, 2013

(87) PCT Pub. No.: WO2012/144213
PCT Pub. Date: Oct. 26, 2012

(65) Prior Publication Data

US 2014/0034195 A1 Feb. 6, 2014

(30) Foreign Application Priority Data

Apr. 21, 2011 (JP) ..... 2011-094871

(51) Int. Cl.

| | |
|---|---|
| ***C22C 38/06*** | (2006.01) |
| ***C22C 38/04*** | (2006.01) |
| ***C21D 8/02*** | (2006.01) |
| ***C22C 38/00*** | (2006.01) |
| ***C22C 38/02*** | (2006.01) |
| ***C21D 9/46*** | (2006.01) |

(52) U.S. Cl.
CPC ..... *C21D 8/0263* (2013.01); *C21D 8/02* (2013.01); *C21D 9/46* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01)

(58) Field of Classification Search
CPC ..... C22C 38/001; C22C 38/02; C22C 38/04; C22C 38/06; C21D 8/0263; C21D 9/46
See application file for complete search history.

(56) References Cited

U.S. PATENT DOCUMENTS 8,372,221 B2 2/2013 Kojima

FOREIGN PATENT DOCUMENTS

| | | | | |
|---|---|---|---|---|
| EP | 0565066 | | | 10/1993 |
| EP | 0672758 | | | 9/1995 |
| EP | 1995340 | | | 11/2008 |
| JP | 05-255804 | | | 10/1993 |
| JP | 6-41683 | A | | 2/1994 |
| JP | 06-212353 | | | 8/1994 |
| JP | 06-248332 | | | 9/1994 |
| JP | 06-248339 | | | 9/1994 |
| JP | 073334 | | | 1/1995 |
| JP | 07188854 | | | 7/1995 |
| JP | 08-311541 | | | 11/1996 |
| JP | 9-227947 | A | | 9/1997 |
| JP | 10-008142 | | | 1/1998 |
| JP | 10-081919 | | | 3/1998 |
| JP | 10245655 | | | 9/1998 |
| JP | 10-280094 | A | | 10/1998 |
| JP | 10330844 | | | 12/1998 |
| JP | 1150195 | | | 2/1999 |
| JP | 2000087147 | | | 3/2000 |
| JP | 2002212673 | | | 7/2002 |
| JP | 2005-320633 | A | | 11/2005 |
| JP | 2005307350 | | | 11/2005 |
| JP | 2005320633 | A | * | 11/2005 |
| JP | 2007009271 | | | 1/2007 |
| JP | 2007092130 | A | * | 4/2007 |
| JP | 2007-239035 | A | | 9/2007 |

(Continued)

OTHER PUBLICATIONS

Extended European Search Report dated Mar. 9, 2015 in European Application No. 12774346.6.

(Continued)

*Primary Examiner* — Matthew E. Hoban
(74) *Attorney, Agent, or Firm* — RatnerPrestia

(57) ABSTRACT

A steel sheet containing C: 0.0005% or more and 0.0035% or less, Si: 0.05% or less, Mn: 0.1% or more and 0.6% or less, P: 0.02% or less, S: less than 0.02%, Al: 0.01% or more and less than 0.10%, N: 0.0030% or less, B: 0.0010% or more, in which the relationship B/N≤3.0 is satisfied and the balance being Fe and inevitable impurities, and a microstructure in which the average integrated intensity f in the (111)[1-10] to (111)[-1-12] orientations on a plane parallel to a sheet surface at a position located at ¼ of the thickness of the steel sheet is 7.0 or more, in which an average ferrite grain size is 6.0 μm or more and 10.0 μm or less, and the relationships $E_{AVE}$≥215 GPa, $E_0$≥210 GPa, $E_{45}$≥210 GPa, $E_{90}$≥210 GPa, and −0.4≤Δr≤0.4 are satisfied.

2 Claims, No Drawings

(56) References Cited

FOREIGN PATENT DOCUMENTS

| | | | |
|---|---|---|---|
| JP | 2009149947 | | 7/2009 |
| JP | 2010-229486 | A | 4/2010 |
| WO | 03031670 | | 4/2003 |
| WO | 2010074308 | | 7/2010 |
| WO | WO 2011/021646 | A | 2/2011 |

OTHER PUBLICATIONS

International Search Report dated Jul. 24, 2012, application No. PCT/JP2012/002709.

* cited by examiner

STEEL SHEET FOR CAN WITH HIGH BARREL-PART BUCKLING STRENGTH UNDER EXTERNAL PRESSURE AND WITH EXCELLENT FORMABILITY AND EXCELLENT SURFACE PROPERTIES AFTER FORMING, AND PROCESS FOR PRODUCING SAME

CROSS REFERENCE TO RELATED APPLICATIONS

This application is the U.S. National Phase application of PCT International Application No. PCT/JP2012/002709, filed Apr. 19, 2012, and claims priority to Japanese Patent Application. No. 2011-094871, filed Apr. 21, 2011, the disclosures of both applications being incorporated herein by reference in their entireties for all purposes.

FIELD OF THE INVENTION

The present invention relates to a steel sheet to be used for a can, the steel sheet being suitable for a can container material used as a material for containers for beverages and food and a method for manufacturing the steel sheet, and, in particular, to a steel sheet excellent in terms of formability and surface quality after forming to be used for a can having a can body with high resistance to buckling against external pressure and a method for manufacturing the steel sheet.

BACKGROUND OF THE INVENTION

Nowadays, from the viewpoint of a decrease in environmental load and cost, it is desirable to reduce the amount of use of steel sheets which are used for cans for food and beverages. Accordingly, the thickness of steel sheets is being reduced regardless of whether the steel sheet is used for two-piece cans or three-piece cans. However, problems due to a decrease in the thickness of steel sheets are recognized. For example, can bodies are deformed due to an external force which is applied when the cans are handled in a can manufacturing process, in a transporting process and in the market and can bodies are deformed (buckled) due to a change in the external pressure of the cans which occurs when a heat sterilization treatment for contents is performed.

Heretofore, the strength of steel sheets has been increased in order to increase the resistance to deformation described above. However, increasing the strength of steel sheets causes a problem in the can manufacturing process, because there is an increase in deformation resistance and heat generation due to working when two-piece cans are formed by performing DI (Draw and wall Ironing) forming or deep drawing and ironing forming. In addition, an increase in the strength of a steel sheet causes an increase in the rate of occurrence of neck wrinkles and flange cracks when neck forming is performed after forming of a can body has been performed and when flange forming is performed thereafter. As described above, increasing the strength of steel sheets is not necessarily an appropriate method for compensating for a decrease in resistance to deformation due to a decrease in the thickness of steel sheets.

On the other hand, the buckling phenomenon of can bodies occurs due to a decrease in the rigidity of the can body caused by a decrease in the thickness of the can bodies. Therefore, in order to increase resistance to buckling (also called paneling strength), it is thought to be effective as a method to optimize the size and design of a can body for increasing the rigidity of the can body.

In addition, it is thought to be effective to increase rigidity by increasing the Young's modulus of a steel sheet. There is a strong correlation between the Young's modulus and crystal orientation of steel. A crystal orientation group ($\alpha$ fibers), in which the <110> orientation is parallel to the rolling direction, increases a Young's modulus in the width direction which is at 90° with respect to the rolling direction, and it is theoretically possible to form a steel sheet having a Young's modulus of about 280 GPa by increasing the integrated intensity of, in particular, the {112}<110> orientation. In addition, a crystal orientation group ($\gamma$ fibers), in which the <111> orientation is parallel to the normal direction of a sheet surface, can increase the Young's moduli in directions at angles of 0°, 45°, and 90° with respect to the rolling direction up to about 230 GPa. On the other hand, in the case where a crystal orientation is not integrated in a particular direction in the steel sheet, that is, a steel sheet has a random texture, the Young's modulus of the steel sheet is about 205 GPa.

Many steel sheets have been provided focusing on a high Young's modulus in order to compensate for a decrease in the rigidity of vehicle bodies due to a decrease in the thickness of steel sheets to be used for automobiles.

For example, Patent Literature 1 discloses a technique for increasing the Young's modulus in a direction at 90° with respect to the rolling direction, the technique including using ultralow-carbon steel containing Nb or Ti, forming a ferritic texture in which the {311}<011> and {332}<113> orientations are accumulated at the hot rolled steel sheet stage by promoting a transformation from a non-recrystallized austenite phase to a ferrite phase in the hot rolling process under the condition that the rolling reduction ratio at a temperature in the range of the $Ar_3$ point to (the $Ar_3$ point+150° C.) is 85% or more, and reforming the original texture into a texture in which the {211}<110> orientation is the primary orientation by performing cold rolling and recrystallization annealing.

In addition, Patent Literature 2 discloses a method for manufacturing a hot-rolled steel sheet having an increased Young's modulus in a direction at 90° with respect to the rolling direction, the method including growing {211}<110> by adding Nb, Mo, and B to a low-carbon steel containing, by mass %, 0.02% to 0.15% of C and by performing hot rolling under the condition that the rolling reduction ratio at a rolling temperature in the range of the $Ar_3$ point to 950° C. is 50% or more.

On the other hand, methods for manufacturing a steel sheet focusing on the high Young's modulus of a steel sheet to be used for a can have been provided for a three-piece can.

Patent Literature 3 discloses a technique for manufacturing a steel sheet to be used for a container having an increased Young's modulus in a direction at 90° with respect to the rolling direction, the method including forming a strong rolled texture, that is, $\alpha$ fibers, by performing second cold rolling under the condition that the rolling reduction ratio is 50% or more, after performing cold rolling and annealing.

Patent Literature 4 discloses a method, without performing annealing, for manufacturing a steel sheet to be used for a container having an increased Young's modulus in a direction at 90° with respect to the rolling direction, the method including forming a strong a fibers by performing cold rolling on a hot-rolled steel sheet under the condition that the rolling reduction ratio is 60% or more.

In addition, Patent Literature 5 discloses a method for manufacturing a steel sheet to be used for a container having an increased Young's modulus in a direction at 90° with respect to the rolling direction, the method including adding Ti, Nb, Zr, and B to an ultralow-carbon steel, performing hot rolling under the condition that the rolling reduction ratio at a temperature equal to or lower than the $Ar_3$ point is at least 50% or more, and performing annealing, after performing cold rolling, at a temperature of 400° C. or higher and equal to or lower than the recrystallization temperature.

On the other hand, in the case of a two-piece can which is manufactured by performing DI forming or deep drawing and ironing forming, there is a marked unevenness in body height at the opening of the formed can, which is called earring, and there is a decrease in yield in the case where the degree of earring is large. There is a problem in that anisotropy (Δr) in the steel sheet plane has to be decreased in order to prevent earring. Moreover, in the case where a laminated steel sheet is formed by a method of manufacturing cans such as DI forming or deep drawing and ironing described above, there is also a problem in that corrosion resistance may decrease due to the delamination of the coating film from the steel sheet which is a base metal after forming a can. That is to say, it is an important factor for a steel sheet, which is to be used as a base metal, to have excellent surface quality so that it does not have a rough surface in order to maintain good adhesiveness with the film even after forming that involves a high degree of working such as deep drawing or ironing has been performed.

In order to solve the problem described above, Patent Literature 6 discloses a steel sheet having good formability and no rough surface and a method for manufacturing the steel sheet, the method including effectively forming the microstructure of a hot-rolled steel sheet and a final product steel sheet to be used for a can so that the microstructure has a small uniform grain size by performing hot rough rolling on ultralow-carbon steel under the conditions that the total rolling reduction ratio is 80% or more and the reduction ratio of the final pass is 20% or more and by ending hot finish rolling under the conditions that reverse transformation due to the generated heat in the rolling occurs when the hot-rolled steel sheet goes through any one of the rolling stands in the finish rolling mill line, so that the finish rolling temperature may be equal to or higher than the $Ar_3$−50° C.

Patent Literature 7 discloses a steel sheet to be used for a two-piece can suppressing the occurrence of earring and having good resistance to surface roughening after press forming has been performed and a method for manufacturing the steel sheet, the method including forming a microstructure after performing hot rolling so that the microstructure has equiaxed crystal grains and small uniform grain size by properly controlling hot rolling conditions such as cooling conditions after performing finish rolling and forming a microstructure having small uniform equiaxed grains after performing annealing so that the steel sheet has a Δr of −0.2 or more and 0.2 or less by maintaining the effects of the hot rolling until after performing cold rolling and annealing.

In addition, Patent Literature 8 discloses a steel sheet having good resistance to surface roughening and a method for manufacturing the steel sheet, the method including adding Nb to ultralow-carbon steel as base material and optimizing a pinning effect by controlling the amount and grain size of precipitates containing Nb to control the grain size of a ferrite phase to be as small as 6 μm to 10 μm.

PATENT LITERATURE

PTL 1: Japanese Unexamined Patent Application Publication No. 5-255804

PTL 2: Japanese Unexamined Patent Application Publication No. 8-311541

PTL 3: Japanese Unexamined Patent Application Publication No. 6-212353

PTL 4: Japanese Unexamined Patent Application Publication No. 6-248332

PTL 5: Japanese Unexamined Patent Application Publication No. 6-248339

PTL 6: Japanese Unexamined Patent Application Publication No. 10-8142

PTL 7: Japanese Unexamined Patent Application Publication No. 10-81919

PTL 8: Japanese Unexamined Patent Application Publication No. 2010-229486

SUMMARY OF THE INVENTION

However, there are problems in all the conventional techniques described above.

Patent Literatures 1 through 5 only disclose methods for increasing the Young's modulus in a direction at 90° with respect to the rolling direction. Although, in the case where a can body of a three-piece can is formed by performing roll forming on a steel sheet manufactured by these methods, it is possible to increase paneling strength by performing forming so that the direction in which the Young's modulus is high is the circumferential direction of the can body, the effect of increasing the rigidity of the can body cannot be sufficiently realized in the case of a two-piece can where the can body is formed by performing drawing, because the direction in which the Young's modulus is high is not always the circumferential direction of the can body. In addition, it is known that, although the accumulation of α fibers increases the Young's modulus in a direction at 90° with respect to the rolling direction, it markedly decreases the Young's modulus in a direction at an angle of 45° with respect to the rolling direction. Therefore, there is concern that there may be a decrease, rather than an increase, in the rigidity of a can body in the case where steel sheets having a high Young's modulus manufactured by the methods described above are formed into two-piece cans. In addition, there is no disclosure of a technique for suppressing the occurrence of earring in the case of a two-piece can which is formed by performing DI forming or deep drawing and ironing or a technique for providing surface quality so that surface roughening does not occur in order to maintain good adhesiveness with a film.

There is no disclosure of a technique for compensating for a decrease in the rigidity of a can body due to a decrease in the thickness of a steel sheet in Patent Literatures 6 through 8.

That is to say, there has not been a technique for a steel sheet and a method for manufacturing the steel sheet, the technique focusing on a steel sheet having a high Young's modulus in order to increase the rigidity of a can body instead of using a high-strength material which compensates for a decrease in the resistance to deformation of a can body due to a decrease in the thickness of a steel sheet but causes a decrease in neck formability and flange formability and having quality of suppressing the occurrence of earring which is required of a material for a two-piece can and resistance to surface roughening (surface quality) after forming the steel sheet.

The present invention has been completed in view of the situation described above and provides a steel sheet with excellent formability and surface quality after forming to be used for a can having a can body with high resistance to buckling against external pressure and a method for manufacturing the steel sheet.

The present inventors diligently conducted investigations in order to solve the problems described above, and, as a result, found that it is possible to manufacture a steel sheet with excellent formability and surface quality after forming to be used for a can having a can body with high buckling resistance against external pressure by optimizing a chemical composition based on ultralow-carbon steel, hot rolling conditions, cold rolling conditions, and annealing conditions, and reached the completion of the present invention on the basis of the knowledge described above.

The present invention has been completed on the basis of the knowledge described above and the subject matter of the present invention includes the following:

[1] A steel sheet with excellent formability and surface quality after forming to be used for a can having a can body with high resistance to buckling against external pressure, the steel sheet having a chemical composition containing, by mass %, C: 0.0005% or more and 0.0035% or less, Si: 0.05% or less, Mn: 0.1% or more and 0.6% or less, P: 0.02% or less, S: less than 0.02%, Al: 0.01% or more and less than 0.10%, N: 0.0030% or less, B: 0.0010% or more, in which the relationship B/N≤3.0 is satisfied, where B/N=(B (mass %))/10.81)/(N (mass %)/14.01), and the balance being Fe and inevitable impurities, and a microstructure in which the average integrated intensity f in the (111)[1-10] to (111)[-1-12] orientations on a plane parallel to a sheet surface at a position located at ¼ of the thickness of the steel sheet is 7.0 or more, in which an average ferrite grain size in a cross section in the rolling direction is 6.0 μm or more and 10.0 μm or less, and the relationships $E_{AVE}$≥215 GPa, $E_0$≥210 GPa, $E_{45}$≥210 GPa, $E_H$≥210 GPa and $-0.4 \leq \Delta r \leq 0.4$ are satisfied, where $$E_{AVE}=(E_0+2E_{45}+E_{90})/4,$$

(where $E_0$, $E_{45}$ and $E_{90}$ are Young's moduli respectively in directions at angles of 0°, 45°, and 90° with respect to the rolling direction), and $$\Delta r=(r_0-2r_{45}+r_{90})/2,$$

(where $r_0$, $r_{45}$, and $r_{90}$ are Lankford values respectively in directions at angles of 0°, 45°, and 90° with respect to the rolling direction).

[2] A method for manufacturing the steel sheet with excellent formability and surface quality after forming to be used for a can having a can body with high resistance to buckling against external pressure according to item [1], the method including hot-rolling a steel slab having a chemical composition containing, by mass %, C: 0.0005% or more and 0.0035% or less, Si: 0.05% or less, Mn: 0.1% or more and 0.6% or less, P: 0.02% or less, S: less than 0.02%, Al: 0.01% or more and less than 0.10%, N: 0.0030% or less, B: 0.0010% or more, in which the relationship B/N≤3.0 is satisfied, where B/N=(B (mass %))/10.81)/(N (mass %)/14.01), and the balance being Fe and inevitable impurities under the conditions that the reheating temperature is 1150° C. to 1300° C. and a finish rolling temperature is 850° C. or higher and 950° C. or lower, coiling the hot-rolled steel sheet at a temperature of 500° C. or higher and 640° C. or lower, pickling the coiled steel sheet, cold-rolling the pickled steel sheet under a condition of a rolling reduction ratio of 87% to 93%, performing recrystallization annealing at a temperature equal to or higher than the recrystallization temperature and 720° C. or lower, and performing skin pass rolling.

Here, % used when describing a chemical composition of steel always represents mass % in the present specification.

According to the present invention, a steel sheet with excellent formability for DI forming and deep drawing and ironing and surface quality after forming to be used for a can having a can body with resistance to buckling higher than the standard value (about 1.5 kgf/cm$^2$), which is set by can and beverage manufacturers, can be achieved.

Therefore, in the case where the steel sheet to be used for a can according to the present invention is used for cans for food and beverages, the rigidity of the can body is increased without a decrease in yield due to occurrence of earring or surface quality after forming a two-piece can and it is possible to further decrease the thickness of a steel sheet to be used for a can, which results in the realization of resource saving and cost saving. In addition, it can be expected that the steel sheet for cans according to the present invention will be applied not only to various kinds of metal cans but also to a wide range of products such as inner cans of dry cell batteries, various kinds of domestic electric appliances, electric parts, and automobile parts.

DETAILED DESCRIPTION OF EMBODIMENTS OF THE INVENTION

The present invention will be described in detail hereafter with reference to exemplary embodiments.

The steel sheet to be used for a can according to an embodiment of the present invention has a chemical composition containing, by mass %, C: 0.0005% or more and 0.0035% or less, Si: 0.05% or less, Mn: 0.1% or more and 0.6% or less, P: 0.02% or less, S: less than 0.02%, Al: 0.01% or more and less than 0.10%, N: 0.0030% or less, B: 0.0010% or more, in which the relationship B/N≤3.0 is satisfied, where B/N=(B (mass %))/10.81)/(N (mass %)/14.01), and the balance being Fe and inevitable impurities, and a microstructure in which the average integrated intensity f in the (111) [1-10] to (111) [-1-12] orientations on a plane parallel to a sheet surface at a position located at ¼ of the thickness of the steel sheet is 7.0 or more, in which an average ferrite grain size in a cross section in the rolling direction is 6.0 μm or more and 10.0 μm or less, and the relationships $E_{AVE}$≥215 GPa, $E_0$≥210 GPa, $E_{45}$≥210 GPa, $E_{90}$≥210 GPa, and $-0.4 \leq \Delta r \leq 0.4$ are satisfied. In addition, the steel sheet to be used for a can described above can be manufactured by hot-rolling a steel slab having the chemical composition described above under the conditions that the reheating temperature is 1150° C. to 1300° C. and a finishing temperature is 850° C. or higher and 950° C. or lower, then coiling the hot-rolled steel sheet at a temperature of 500° C. or higher and 640° C. or lower, pickling the coiled steel sheet, cold-rolling the resultant steel sheet under a condition of a rolling reduction ratio of 87% to 93%, performing recrystallization annealing at a temperature equal to or higher than the recrystallization temperature and 720° C. or lower, and performing skin pass rolling under a condition of an elongation of 0.5% or more and 5% or less. These are the most preferred aspects of the present invention.

Firstly, the chemical composition according to an embodiment of the present invention will be described.

C: 0.0005% or more and 0.0035% or less

In general, since yield elongation is increased with an increase in the amount of C in solution in steel, which tends to cause age hardening and occurrence of stretcher strain when forming is performed, it is necessary that the C content be controlled to be as small as possible at the steel making stage in the case where a continuous annealing method is used. In addition, since, in the case where the amount of residual C in solution is increased, a crack tends to occur when stretch flange forming in the seaming portion is performed at the final stage of a can making process and the degree of work hardening tends to become large, there is concern that wrinkles may occur when neck forming or flange forming is performed. Therefore, the C content is set to be 0.0035% or less. In addition, C is a chemical element which has an influence on recrystallized texture. The integrated intensity of a crystal orientation group in which the <111> orientation is parallel to the normal direction of a sheet surface increases with a decrease in C content. It is necessary that the integrated intensity of this crystal orientation group be increased in order to increase an average Young's modulus, and, in the case where the C content is less than 0.0005%, an average Young's modulus is decreased rather than increased, because the {100}<110> orientation, which causes a decrease in Young's modulus in a direction at an angle of 45° with respect to the rolling direction, tends to be maintained. Therefore, the C content is set to be 0.0005% or more.

Si: 0.05% or less

Since there is a problem in that there is a decrease in the surface treatment performance and corrosion resistance of a steel sheet in the case where the Si content is large, the Si content is set to be 0.05% or less, preferably 0.02% or less.

Mn: 0.1% or more and 0.6% or less

It is necessary that the Mn content be 0.1% or more in order to prevent a decrease in hot ductility due to S which is an impurity contained in steel. Since Mn is one of the chemical elements which decrease the $Ar_3$ transformation point, Mn can decrease a finish rolling temperature of hot rolling, which results in the growth of recrystallized γ grains being suppressed in hot rolling and further in a decrease in α grain size after transformation has occurred. In addition, according to the present invention, excellent surface quality after forming cans can be obtained by realizing further decrease in grain size through the addition of Mn, in addition to an effect of a decrease in grain size through the addition of B as described below. The Mn content is set to be 0.1% or more in order to realize the effects described above. On the other hand, the upper limit of the Mn content of a tin mill black plate which is used as a material for a normal food container is set to be 0.6% or less in terms of ladle analysis value according to JIS G 3303 and the standards produced by American Society for Testing Materials (ASTM). Therefore, the Mn content is set to be 0.6% or less.

P: 0.02% or less

P causes a decrease in the hardness and corrosion resistance of steel in the case where the P content is large. Therefore, the P content is set to be 0.02% or less.

S: less than 0.02%

S forms MnS in combination with Mn in steel and causes a decrease in the hot ductility of steel as a result of precipitation in a large amount. Therefore the S content is set to be less than 0.02%.

Al: 0.01% or more and less than 0.10%

Al is a chemical element which is added as a deoxidation agent and effective for decreasing the amount of N in solution in steel as a result of forming AlN in combination with N. However, the sufficient effects of deoxidation and decreasing the amount of N in solution cannot be realized in the case where the Al content is less than 0.01%. Therefore, the Al content is set to be 0.01% or more. On the other hand, it is undesirable that the Al content be 0.10% or more not only because the effects described above saturate but also because the amount of inclusions such as alumina is increased. Therefore, the Al content is set to be 0.01% or more and less than 0.10%.

N: 0.0030% or less

N is an impurity which is inevitably mixed in. It is necessary that the B content be increased with an increase in N content in order to fix the increased amount of N. Since a large increase in B content causes an increase in cost, the N content is set to be 0.0030% or less.

B: 0.0010% or more and B/N≤3.0

B is effective for preventing age hardening as a result of precipitating in the form of BN in combination with N in solution in steel. In addition, it is recognized that B is effective for refining the grain of a hot-rolled steel sheet and an annealed steel sheet in the case where the B content is more than necessary to be precipitated in the form of BN. This is thought that excessively added B is segregated at grain boundaries in the form of B in solution, which suppresses the growth of crystal grains. It is necessary that B be present in the form of B in solution in addition to B which is precipitated in the form of BN in order to exert such effect of B on refining the grain. From the results of the various tests conducted by the present inventors, it was found that it is necessary that the B content be 0.0010% or more in order to realize both effects of preventing age hardening and grain refinement. Therefore, the B content is set to be 0.0010% or more. On the other hand, an increase in the amount of B in solution causes an excessive increase in temperature at which recrystallization is finished in a continuous annealing process, which results in an increase in the risk of the occurrence of buckling and fracture in an annealing furnace. Therefore, the relationship B/N≤3.0 is set to be satisfied, preferably B/N≥1.1 in order that B in solution is present with certainty in a practical process in which the amount of N varies. Here, B/N is defined by the equation B/N=(B (mass %))/10.81)/(N (mass %)/14.01).

The remainder of the chemical composition consists of Fe and inevitable impurities.

Secondly, the texture and material properties according to embodiments of the present invention will be described.

Texture: average integrated intensity f in the (111)[1-10] to (111)[-1-12] orientations is 7.0 or more The Young's moduli in directions at angles of 0°, 45°, and 90° with respect to the rolling direction can be isotropically increased by promoting the growth of a texture in the (111)[1-10] to (111)[-1-12] orientations, and in order to achieve this, it is necessary that an average integrated intensity f in the (111)[1-10] to (111)[-1-12] orientations on a plane parallel to a sheet surface at a position located at ¼ of the thickness of the steel sheet be 7.0 or more.

$$E_{AVE} \geq 215 \text{ GPa}, E_0 \geq 210 \text{ GPa}, E_{45} \geq 210 \text{ GPa}, E_{90} \geq 210 \text{ GPa}$$

Here, $E_{AVE}=(E_0+E_{45}+E_{90})/4$, where $E_0$, $E_{45}$, and $E_{90}$ are Young's moduli respectively in directions at angles of 0°, 45°, and 90° with respect to the rolling direction. $E_{AVE}$ is set to be 215 GPa or more from the viewpoint of an increase in the rigidity of a can body. Since there is a significant increase in paneling strength in the case where $E_{AVE}$ is 215 GPa or more, it is possible to prevent the deformation of a can body which is caused by a decrease in thickness and due to change in the external pressure of the can which occurs, for example, in a heat sterilization treatment for the content of the can.

On the other hand, anisotropy of the Young's modulus of a steel sheet becomes a problem in the case of a two-piece can which is formed by performing drawing. That is to say, in the case where one or two of $E_0$, $E_{45}$, and $E_{90}$ are high and the rest are low, a sufficient effect of increasing the rigidity of a can body cannot be realized even if the relationship $E_{AVE} \geq 215$ GPa is satisfied. It is necessary that each of $E_0$, $E_{45}$, and $E_{90}$ be 210 GPa or more in order to increase the rigidity of a can body.

Average ferrite grain size: 6.0 μm or more and 10.0 μm or less

In the case of a laminated steel sheet, there is a case in which a film is detached from a steel sheet or a film is fractured due to stress concentration on the film, which results in a decrease in corrosion resistance due to exposure of a steel sheet which is a base metal. This problem is caused by the surface roughening of the steel sheet after DI forming or deep drawing and ironing forming has been performed, and the degree of surface roughening is increased in proportion to a ferrite grain size. Therefore, an average ferrite grain size in the cross section in the rolling direction of a steel sheet which is used as a base metal is set to be 10.0 μm or less, preferably 9.0 μm or less. On the other hand, in the case where a grain size is excessively small, there is a marked increase in the strength of a steel sheet due to strengthening by grain refinement. Therefore, an average ferrite grain size in the cross section in the rolling direction is set to be 6.0 μm or more.

$$-0.4 \leq \Delta r \leq 0.4$$

In the present invention, Δr which is defined by the equation below is used as an indicator of earring.

$$\Delta r = (r_0 - 2r_{45} + r_{90})/2,$$

where $r_0$, $r_{45}$, $r_{90}$ are Lankford values (hereinafter, also called r value) respectively in directions at angles of 0°, 45°, and 90° with respect to the rolling direction.

In the case of a steel sheet having a Δr of more than 0.4 or less than −0.4, a large degree of earring occurs when DI forming or deep drawing and ironing forming is performed, which results in a considerable decrease in yield due to a large allowance of trimming. It is necessary that Δr be in a range of −0.4 or more and 0.4 or less in order to suppress the occurrence of earring from the viewpoint of yield.

Δr can be controlled to be in a certain range by adjusting a cold rolling reduction ratio.

Hereinafter, the preferred method for manufacturing a steel sheet to be used for a can according to the present invention will be described.

The steel sheet to be used for a can according to the present invention can be manufactured by hot-rolling a steel slab having a chemical composition described above under the conditions that the reheating temperature is 1150° C. to 1300° C. and a finish rolling temperature is 850° C. or higher and 950° C. or lower, then coiling the hot-rolled steel sheet at a coiling temperature of 500° C. or higher and 640° C. or lower, pickling the coiled steel sheet, cold-rolling the pickled steel sheet under a condition of a rolling reduction ratio of 87% to 93%, performing recrystallization annealing at a temperature equal to or higher than the recrystallization temperature and 720° C. or lower, and performing skin pass rolling under a condition of an elongation of 0.5% or more and 5% or less.

Slab reheating temperature: 1150° C. to 1300° C.

There are problems such as the defects of a product surface and an increase in energy cost in the case where a slab reheating temperature before hot rolling is performed is excessively high. On the other hand, it is difficult to achieve an appropriate finish rolling temperature in the case where the reheating temperature is excessively low. Therefore, the slab reheating temperature is set to be 1150° C. to 1300° C.

Finish rolling temperature: 850° C. or higher and 950° C. or lower, coiling temperature: 500° C. or higher and 640° C. or lower A finish rolling temperature is set to be 850° C. or higher and 950° C. or lower and a coiling temperature is set to be 500° C. or higher and 640° C. or lower from the viewpoint of a decrease in the grain size and uniformity of the distribution of precipitations of a hot-rolled steel sheet.

In the case where the finish rolling temperature is higher than 950° C., the growth of γ grains is strongly promoted after the rolling, which results in an increase in α grain size after transformation has occurred due to an increase in γ grain size. In addition, in the case where the finish rolling temperature is lower than 850° C., there is an increase in α grain size, because rolling is performed at a temperature equal to or lower than the $Ar_3$ transformation point. In the case where a coiling temperature is excessively low, there is a deterioration in the shape of a hot-rolled steel sheet, which results in negative effects on the operation of the succeeding processes such as pickling and cold rolling, and therefore a coiling temperature is set to be 500° C. or higher. On the other hand, in the case where the coiling temperature is higher than 640° C., there may be a decrease in descaling performance in the succeeding pickling process due to a marked increase in the thickness of the scale of a steel sheet. It is preferable that the coiling temperature be 620° C. or lower in order to solve the problem described above more effectively.

There is no particular limitation on pickling conditions as long as scale on the surface layer is removed. Pickling may be performed using a common method.

Rolling reduction ratio: 87% to 93%

The cold rolling reduction ratio is an important factor from the viewpoint of the control of a texture, that is, Young's modulus and Δr.

In general, it is known that the anisotropy of the Young's modulus and r value depends on a texture. Since the texture of a steel sheet after annealing has been performed is influenced not only by a rolling reduction ratio but also by the contents of Mn and B and a coiling temperature, it is necessary that the rolling reduction ratio be appropriately set in relation to the contents of Mn and B and a coiling temperature in a hot rolling process described above. By optimizing the rolling reduction ratio, rotation to the (111)[1-10] to (111)[-1-12] orientations can be realized, which is effective for increasing $E_{AVE}$ and decreasing |Δr|. Specifically, by controlling the rolling reduction ratio to be 87% to 93%, the relationships $E_{AVE} \geq 215$ GPa, $E_0 \geq 210$ GPa, $E_{45} \geq 210$ GPa, $E_{90} \geq 210$ GPa, and $-0.4 \leq \Delta r \leq 0.4$ as desired can be satisfied.

Annealing temperature: equal to or higher than the recrystallization temperature and 720° C. or lower It is preferable that a continuous annealing method be used among annealing methods from the viewpoint of the uniformity of material properties and high productivity. Although it is essential that an annealing temperature is equal to or higher than the recrystallization temperature in continuous annealing, there is an increase in grain size in the case where the annealing temperature is excessively high, which results not only in worse surface roughening after forming but also in an increase in the risk of the occurrence of buckling and fracture in an annealing furnace in the case of thin materials such as a steel sheet to be used for a can. Therefore, the upper limit of the annealing temperature is set to be 720° C.

Elongation: 0.5% or more and 5% or less (preferable condition)

Although the elongation of skin pass rolling is appropriately determined in accordance with temper degree of a steel sheet, it is preferable that the elongation be 0.5% or more in order to suppress the occurrence of stretcher strain. On the other hand, there is an increase in the hardness of a steel sheet in the case where rolling is performed under the condition that the elongation is more than 5%, which results in a decrease in formability and a decrease in ductility, and, moreover, may result in a decrease in r value and an increase in the planar anisotropy of r value. Therefore, it is preferable that the upper limit be 5%, more preferably 4% or less.

EXAMPLES

Steels having chemical compositions A through H given in Table 1 and the remainder consisting of Fe and inevitable impurities were produced by melting, from which steel slabs were obtained. The obtained steel slabs were reheated at a temperature of 1200° C. and subjected to hot rolling under the conditions that the finish rolling temperature was 880° C. to 890° C. and a coiling temperature was 560° C. to 650° C. Subsequently, the hot-rolled steel sheets were, after being pickled, subjected to cold rolling under the condition that the rolling reduction ratio was 86% to 93.5% and made into steel sheets having a thickness of 0.225 mm to 0.260 mm. The obtained steel sheets were subjected to annealing using a continuous annealing furnace under the conditions that the annealing temperature was 660° C. to 730° C. and an annealing time was 30 seconds and subjected to skin pass rolling under the condition that the elongation was 2.0%. Here, details are given in Table 2.

For each of the obtained steel sheets, average integrated intensity f in the (111)[1-10] to (111)[-1-12] orientations on a plane parallel to a sheet surface at a position located at ¼ of the thickness of the steel sheet, Young's modulus, Δr, and average ferrite grain size were observed.

Average integrated intensity f in the (111)[1-10] to (111)[-1-12] orientations on a plane parallel to a sheet surface at a position located at ¼ of the thickness of the steel sheet Integrated intensity f was observed at the position located at ¼ of the thickness, after chemical polishing (oxalic acid etching) had been performed in order to remove the influence of work strain. X-ray diffractometer was used for the observation, and (110), (200), (211), and (222) pole figures were created by the Schultz reflection method. Orientation distribution function (ODF) was derived from these pole figures, and average integrated intensity in the (111)[1-10] to (111)[-1-12] orientations was defined as an average value of integrated intensities for $\phi1=0°, 5°, 10°, \ldots 90°$ (the angles 0° to 90° at intervals of 5° were assigned to $\phi1$) at $\phi2=45°$ and $\Phi=55°$ in the Euler space (Bunge method).

Young's Modulus

An average Young's modulus $E_{AVE}$ $[=(E_0+2E_{45}+E_{90})/4]$ was derived by observing the Young's moduli $E_0$, $E_{45}$, $E_{90}$ (GPa) in directions at angles of 0°, 45°, and 90° with respect to the rolling direction in accordance with the standards produced by American Society for Testing Materials (C1259) using a resonant frequency measuring machine of a transverse oscillation type with test specimens which were cut out from the steel sheet having a size of 10 mm×35 mm so that the longitudinal directions of the specimens were respectively in the direction of 0°, 45°, and 90° with respect to the rolling direction.

Δr $\Delta r[(r_0+r_{90}-2r_{45})/2]$ was derived by calculating an r value in accordance with JIS Z 2254 "Metallic materials-Sheet and strip-Determination of plastic strain ratio" using a JIS NO. 13 B half size tensile test specimen (having a width of 12.5 mm, a parallel length of 35 mm, and a gauge length of 20 mm). $r_0$, $r_{45}$, and $r_{90}$ respectively denote r values under the conditions that the tensile directions were directions at angles of 0°, 45°, and 90° with respect to the rolling direction.

Average Ferrite Grain Size

Grain boundaries of a ferrite microstructure in the cross section in the rolling direction was exposed through the use of etching with 3% nital solution, and the photograph of the microstructure was taken using an optical microscope at a magnification of 400 times. Average ferrite grain size was observed using the taken photograph and a sectioning method in accordance with JIS G 0551 Steels-Micrographic determination of the apparent grain size.

Moreover, a two-piece can was formed using the steel sheet described above in order to evaluate the properties of a can body after can making has been performed. Specifically, the steel sheet described above was subjected to a surface treatment using chromium plating (tin free) and then made into a laminated steel sheet which was coated with an organic film. Subsequently, the laminated sheet was punched into a circular shape and then formed into a can body, which is similar to that of a two-piece can to be used as a can for a beverage, by performing forming such as deep drawing and ironing.

The resistance to external pressure of the can body obtained as described above was observed. The observation method will be described hereafter.

The can body was placed in a pressure chamber, and pressure was applied by feeding pressurized air through an air inlet valve at pressurization rate of 0.016 MPa/s. The internal pressure of the chamber was confirmed using a pressure gauge, a pressure sensor, an amplifier which amplifies the detected signals, and a signal processing system for the display of the detected signals, data processing and the like. A critical buckling pressure, that is, resistance to external pressure was defined as the pressure at the turning point of the pressure due to the occurrence of buckling. In general, it is thought that resistance to external pressure is sufficient against change in pressure due to a heat sterilization treatment if it is 0.14 MPa or more. Therefore, a case in which resistance to external pressure is more than 0.14 MPa is represented by ○, and a case in which resistance to external pressure is 0.14 MPa or less is represented by x.

In order to evaluate the surface roughening of the surface of a steel sheet after can forming has been performed, the surface roughness of a can body was observed and a maximum height Rmax was investigated. The laminated film with which the can body was coated was removed using a NaOH solution, and the surface roughness of a steel sheet of the can body, in which the degree of working is the highest, was observed. It was found that the film was not damaged in the case where a maximum height Rmax of the surface of the steel sheet was less than 7.4 μm, which means corrosion resistance was maintained. Therefore, in the present invention, a case where a maximum height Rmax is less than 7.4 μm is evaluated as the case of a small occurrence rate of surface roughening (◎), a case where a maximum height Rmax is 7.4 μm or more and less than 9.5 μm is evaluated as the case of a comparatively small occurrence rate of surface roughening (○), and a case where a maximum height Rmax is 9.5 μm or more is evaluated as the case of a large occurrence rate of surface roughening (x).

The results are given in Table 3.

TABLE 1

| No. | Classification | C | Si | Mn | P | S | Al | N | B | B/N Atomic Ratio |
|---|---|---|---|---|---|---|---|---|---|---|
| | | (mass %) | | | | | | | | |
| A | Example | 0.0020 | 0.010 | 0.35 | 0.009 | 0.0090 | 0.048 | 0.0014 | 0.0017 | 1.57 |
| B | Example | 0.0015 | 0.010 | 0.60 | 0.010 | 0.0092 | 0.051 | 0.0013 | 0.0010 | 1.00 |
| C | Example | 0.0020 | 0.010 | 0.59 | 0.010 | 0.0094 | 0.048 | 0.0016 | 0.0029 | 2.35 |
| D | Comparative Example | 0.0018 | 0.010 | 0.33 | 0.011 | 0.0180 | 0.042 | 0.0022 | 0.0008 | 0.47 |
| E | Comparative Example | 0.0400 | 0.015 | 0.20 | 0.010 | 0.0110 | 0.065 | 0.0015 | 0.0003 | 0.22 |
| F | Comparative Example | 0.0020 | 0.010 | 0.60 | 0.010 | 0.0100 | 0.050 | 0.0015 | 0.0036 | 3.11 |
| G | Example | 0.0020 | 0.010 | 0.60 | 0.010 | 0.0100 | 0.050 | 0.0029 | 0.0066 | 2.95 |
| H | Example | 0.0020 | 0.010 | 0.60 | 0.010 | 0.0100 | 0.050 | 0.0028 | 0.0024 | 1.11 |

TABLE 2

| No. | Chemical Composition of Steel | Slab Reheating Temperature (° C.) | Finish Rolling Temperature (° C.) | Coiling Temperature (° C.) | Cold Rolling Reduction Ratio (%) | Annealing Temperature (° C.) | Final Thickness (mm) | Elongation Ratio (%) | Note |
|---|---|---|---|---|---|---|---|---|---|
| 1 | A | 1200 | 890 | 560 | 91.3 | 710 | 0.225 | 2.0 | Example |
| 2 | A | 1200 | 890 | 560 | 90.2 | 710 | 0.225 | 2.0 | Example |
| 3 | A | 1200 | 890 | 560 | 88.8 | 710 | 0.225 | 2.0 | Example |
| 4 | A | 1200 | 890 | 620 | 91.3 | 710 | 0.225 | 2.0 | Example |
| 5 | A | 1200 | 890 | 620 | 86 | 710 | 0.225 | 2.0 | Comparative Example |
| 6 | A | 1200 | 890 | 620 | 91.3 | 730 | 0.225 | 2.0 | Comparative Example |
| 7 | B | 1200 | 890 | 560 | 90.2 | 710 | 0.225 | 2.0 | Example |
| 8 | B | 1200 | 890 | 560 | 88.8 | 710 | 0.225 | 2.0 | Example |
| 9 | B | 1200 | 890 | 560 | 87.5 | 710 | 0.225 | 2.0 | Example |
| 10 | B | 1200 | 890 | 620 | 91.3 | 710 | 0.225 | 2.0 | Example |
| 11 | C | 1200 | 890 | 560 | 91.3 | 710 | 0.225 | 2.0 | Example |
| 12 | C | 1200 | 890 | 560 | 90.2 | 710 | 0.225 | 2.0 | Example |
| 13 | C | 1200 | 890 | 560 | 88.8 | 710 | 0.225 | 2.0 | Example |
| 14 | C | 1200 | 890 | 560 | 87.5 | 710 | 0.225 | 2.0 | Example |
| 15 | C | 1200 | 890 | 560 | 93.5 | 710 | 0.225 | 2.0 | Comparative Example |
| 16 | C | 1200 | 890 | 650 | 91.3 | 660 | 0.225 | 2.0 | Comparative Example |
| 17 | C | 1200 | 890 | 650 | 91.3 | 710 | 0.225 | 2.0 | Comparative Example |
| 18 | D | 1200 | 890 | 620 | 88.7 | 670 | 0.260 | 2.0 | Comparative Example |
| 19 | E | 1200 | 880 | 620 | 88.7 | 700 | 0.225 | 2.0 | Comparative Example |
| 20 | F | 1200 | 890 | 620 | 91.3 | 720 | 0.225 | — | Comparative Example |
| 21 | G | 1200 | 890 | 560 | 91.3 | 710 | 0.225 | 2.0 | Example |
| 22 | H | 1200 | 890 | 560 | 91.3 | 710 | 0.225 | 2.0 | Example |
| 23 | H | 1200 | 890 | 560 | 91.3 | 710 | 0.225 | 1.0 | Example |
| 24 | H | 1200 | 890 | 560 | 91.3 | 710 | 0.225 | 4.0 | Example |
| 25 | H | 1200 | 890 | 560 | 91.3 | 710 | 0.225 | 5.0 | Example |

TABLE 3

| No. | Chemical Composition of Steel | f | Young's Modulus (GPa) $E_0$ | $E_{45}$ | $E_{90}$ | $E_{AVE}$ | r Value $r_0$ | $r_{45}$ | $r_{90}$ | Δr | Grain Size (μm) | Can Body Properties: Resistance to External Pressure | Can Body Properties: Rough Surface | Note |
|---|---|---|---|---|---|---|---|---|---|---|---|---|---|---|
| 1 | A | 10.1 | 211 | 216 | 218 | 215 | 1.41 | 1.39 | 1.49 | 0.06 | 9.6 | ○ | ○ | Example |
| 2 | A | 11.9 | 216 | 218 | 220 | 218 | 1.52 | 1.28 | 1.45 | 0.21 | 10.0 | ○ | ○ | Example |
| 3 | A | 8.38 | 214 | 220 | 216 | 218 | 1.63 | 1.30 | 1.53 | 0.28 | 10.0 | ○ | ○ | Example |
| 4 | A | 9.35 | 215 | 216 | 218 | 216 | 1.44 | 1.41 | 1.52 | 0.07 | 10.0 | ○ | ○ | Example |
| 5 | A | 8.75 | 210 | 220 | 213 | 216 | 1.78 | 1.25 | 1.56 | 0.42 | 10.5 | ○ | x | Comparative Example |
| 6 | A | 10.1 | 211 | 216 | 218 | 215 | 1.52 | 1.45 | 1.55 | 0.09 | 11.4 | ○ | x | Comparative Example |
| 7 | B | 8.52 | 216 | 218 | 216 | 217 | 1.35 | 1.20 | 1.28 | 0.12 | 9.0 | ○ | ○ | Example |
| 8 | B | 8.42 | 214 | 220 | 214 | 217 | 1.51 | 1.21 | 1.42 | 0.26 | 8.8 | ○ | ⊙ | Example |
| 9 | B | 7.91 | 213 | 221 | 213 | 217 | 1.46 | 1.17 | 1.46 | 0.29 | 9.4 | ○ | ○ | Example |
| 10 | B | 8.81 | 215 | 216 | 216 | 216 | 1.37 | 1.34 | 1.34 | 0.01 | 9.4 | ○ | ○ | Example |
| 11 | C | 8.56 | 216 | 214 | 219 | 216 | 1.09 | 1.24 | 1.09 | −0.15 | 6.8 | ○ | ⊙ | Example |
| 12 | C | 8.27 | 212 | 214 | 220 | 215 | 1.18 | 1.15 | 1.19 | 0.04 | 6.8 | ○ | ⊙ | Example |
| 13 | C | 7.59 | 219 | 214 | 217 | 216 | 1.22 | 1.17 | 1.26 | 0.07 | 6.8 | ○ | ⊙ | Example |
| 14 | C | 7.37 | 212 | 218 | 217 | 216 | 1.35 | 1.12 | 1.23 | 0.17 | 7.0 | ○ | ⊙ | Example |
| 15 | C | 9.25 | 213 | 213 | 221 | 215 | 0.99 | 1.45 | 0.98 | −0.47 | 6.7 | ○ | ⊙ | Comparative Example |
| 16 | C | — | — | — | — | — | — | — | — | — | — | — | — | Comparative Example (Non-recrystallization) |
| 17 | C | 8.60 | 216 | 214 | 215 | 215 | 1.12 | 1.35 | 1.15 | −0.22 | 10.1 | ○ | x | Comparative Example |

TABLE 3-continued

| No. | Chemical Composition of Steel | f | Young's Modulus (GPa) $E_0$ | $E_{45}$ | $E_{90}$ | $E_{AVE}$ | r Value $r_0$ | $r_{45}$ | $r_{90}$ | Δr | Grain Size (μm) | Can Body Properties: Resistance to External Pressure | Rough Surface | Note |
|---|---|---|---|---|---|---|---|---|---|---|---|---|---|---|
| 18 | D | 8.70 | 210 | 220 | 218 | 217 | 1.61 | 1.52 | 1.90 | 0.24 | 11.0 | ○ | x | Comparative Example |
| 19 | E | 4.98 | 202 | 202 | 210 | 204 | 0.89 | 1.06 | 1.03 | −0.10 | 6.0 | x | ⊙ | Comparative Example |
| 20 | F | — | — | — | — | — | — | — | — | — | — | — | — | Comparative Example (Non-recrystallization) |
| 21 | G | 10.5 | 217 | 212 | 223 | 216 | 1.10 | 1.25 | 1.15 | −0.13 | 6.6 | ○ | ⊙ | Example |
| 22 | H | 8.74 | 215 | 216 | 216 | 216 | 1.36 | 1.34 | 1.33 | 0.01 | 8.3 | ○ | ○ | Example |
| 23 | H | 8.82 | 214 | 215 | 214 | 215 | 1.36 | 1.33 | 1.33 | 0.02 | 8.2 | ○ | ○ | Example |
| 24 | H | 8.89 | 215 | 216 | 216 | 216 | 1.35 | 1.36 | 1.32 | −0.03 | 8.3 | ○ | ○ | Example |
| 25 | H | 9.00 | 216 | 217 | 217 | 217 | 1.34 | 1.38 | 1.31 | −0.05 | 8.4 | ○ | ○ | Example |

Table 3 indicates that, in each of all the cases of the examples of the present invention, an average integrated intensity in the (111)[1-10] to (111)[-1-12] orientations on a plane parallel to a sheet surface at a position located at ¼ of the thickness was 7.0 or more, the relationships $E_{AVE}$≥215 GPa, $E_0$≥210 GPa, $E_{45}$≥210 GPa, $E_{90}$≥210 GPa, and −0.4≤Δr≤0.4 were satisfied and an average ferrite crystal grain size was 6.0 μm or more and 10.0 μm or less, which means that the examples have high resistance to external pressure and excellent formability and surface quality.

On the other hand, in the case of comparative example No. 5, since a cold rolling reduction ratio was less than the range according to the present invention, Δr was more than the upper limit according to the present invention. In the case of comparative example No. 6, since an annealing temperature was higher than the range according to the present invention, crystal grains were, large, which resulted in the occurrence of surface roughening. In the case of comparative example No. 15, since a cold rolling reduction ratio was more than the range according to the present invention, Δr was less than the lower limit according to the present invention. In the case of comparative example No. 16, since annealing was performed at a temperature lower than the recrystallization temperature, non-recrystallized structures were observed in some parts. In the case of comparative example No. 17, since a coiling temperature was higher than the range according to the present invention, the effect of grain refining by decreasing a coiling temperature was not realized, which resulted in the crystal grain size of the steel sheet which had been subjected to skin pass rolling being larger than the upper limit according to the present invention. In the case of comparative example No. 18, since B was less than the range according to the present invention, the effect of grain refinement through the use of B was not sufficiently realized, which resulted in the crystal grain size of the steel sheet which had been subjected to skin pass rolling being larger than the upper limit according to the present invention. Moreover, in the case of comparative example No. 19, since the C content is more than the range according to the present invention, an average integrated intensity in the (111)[1-10] to (111)[-1-12] orientations on a plane parallel to a sheet surface at a position located at ¼ of the thickness was less than the range according to the present invention, which resulted in an increase in Young's modulus being not sufficiently achieved. In the case of comparative example No. 20, since B/N is more than the range according to the present invention, there was an increase in the temperature of completion of recrystallization, which resulted in non-recrystallized structures being observed in some parts as a result of annealing performed under conditions within the range according to the present invention.

The invention claimed is:

1. A steel sheet with excellent formability and surface quality after forming to be used for a can having a can body with high resistance to buckling against external pressure, the steel sheet having a chemical composition containing, by mass %, C: 0.0005% or more and 0.0035% or less, Si: 0.05% or less, Mn: 0.1% or more and 0.6% or less, P: 0.02% or less, S: less than 0.02%, Al: 0.01% or more and less than 0.10%, N: 0.0030% or less, B: 0.0010% or more, in which the relationship B/N≤3.0 is satisfied where B/N=(B (mass %)/10.81)/(N (mass %)/14.01), and the balance being Fe and inevitable impurities, and a microstructure in which the average integrated intensity f in the (111)[1-10] to (111)[-1-12] orientations on a plane parallel to a sheet surface at a position located at ¼ of the thickness of the steel sheet is 7.0 or more, wherein an average ferrite grain size in a cross section in the rolling direction is 6.0 μm or more and 10.0 μm or less, and the relationships $E_{AVE}$≥215 GPa, $E_0$≥210 GPa, $E_{45}$≥210 GPa, $E_{90}$≥210 GPa, and −0.4≤Δr≤0.4 are satisfied, where $$E_{AVE}=(E_0+2E_{45}+E_{90})/4,$$

where $E_0$, $E_{45}$, and $E_{90}$ are Young's moduli respectively in directions at angles of 0°, 45°, and 90° with respect to the rolling direction, and $$\Delta r=(r_0-2r_{45}+r_{90})/2,$$

where $r_0$, $r_{45}$, and $r_{90}$ are Lankford values respectively in directions at angles of 0°, 45°, and 90° with respect to the rolling direction.

2. A method for manufacturing the steel sheet with excellent formability and surface quality after forming to be used for a can having a can body with high resistance to buckling against external pressure according to claim 1, the method comprising hot-rolling a steel slab having a chemical composition containing, by mass %, C: 0.0005% or more and 0.0035% or less, Si: 0.05% or less, Mn: 0.1% or more and 0.6% or less, P: 0.02% or less, S: less than 0.02%, Al: 0.01% or more and less than 0.10%, N: 0.0030% or less, B: 0.0010% or more, in which the relationship B/N≤3.0 is satisfied, where B/N=(B (mass %)/10.81)/(N (mass %)/14.01), and the balance being Fe and inevitable impurities under the conditions that the reheating temperature is 1150° C. to 1300° C. and a finish rolling temperature is 850° C. or higher and 950° C. or lower, coiling the hot-rolled steel sheet at a temperature of 500° C. or higher and 640° C. or lower, pickling the coiled steel sheet, cold-rolling the pickled steel sheet under a condition of a rolling reduction ratio of 87% to 93%, performing recrystallization annealing at a temperature equal to or higher than the recrystallization temperature and 720° C. or lower, and performing skin pass rolling.

* * * * *